US011817661B2

(12) United States Patent
Henrici et al.

(10) Patent No.: US 11,817,661 B2
(45) Date of Patent: Nov. 14, 2023

(54) LAMP SOCKET WITH VENTILATION CHANNEL

(71) Applicant: BJB GmbH & Co. KG, Arnsberg (DE)

(72) Inventors: Philipp Henrici, Arnsberg (DE); Olaf Baumeister, Sundern (DE); Robert Buhl, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 17/734,256

(22) Filed: May 2, 2022

(65) Prior Publication Data

US 2022/0376448 A1 Nov. 24, 2022

(30) Foreign Application Priority Data

May 18, 2021 (DE) ..... 102021112797.1

(51) Int. Cl.
*H01R 33/05* (2006.01)
*F21V 23/06* (2006.01)
*H01R 33/09* (2006.01)

(52) U.S. Cl.
CPC ..... *H01R 33/05* (2013.01); *F21V 23/06* (2013.01); *H01R 33/09* (2013.01)

(58) Field of Classification Search
CPC ..... H01R 33/09; H01R 33/94; H01R 33/965; H01R 13/5227; H01R 33/05; F21V 23/06
See application file for complete search history.

(56) References Cited

U.S. PATENT DOCUMENTS 6,648,691 B2 * 11/2003 Henrici ..... H01R 33/09 439/619
7,618,275 B2 * 11/2009 Owen, Sr. ..... F21V 19/0005 439/699.2
10,724,715 B1 * 7/2020 Xu ..... F21V 23/06

FOREIGN PATENT DOCUMENTS

| | | | |
|---|---|---|---|
| CN | 2622887 | Y | 6/2004 |
| DE | 4031167 | A1 | 4/1991 |
| DE | 202021102682 | U1 | 5/2021 |
| DE | 202021102683 | U1 | 5/2021 |
| DE | 202021102684 | U1 | 5/2021 |

* cited by examiner

*Primary Examiner* — Oscar C Jimenez
*Assistant Examiner* — Paul D Baillargeon
(74) *Attorney, Agent, or Firm* — Von Rohrscheidt Patents

(57) ABSTRACT

A G9 lamp socket for a cooking appliance light, the G9 lamp socket including a socket body including an upper structure and a lower structure; a base receiver configured to receive a lamp base of a G9 lamp, the base receiver including an entry opening formed in the upper structure and extending along a longitudinal axis of the socket body into the lower structure; at least two socket contacts arranged opposite to one another wherein the base receiver is arranged between the at least two socket contacts; at least two connection contacts connected with the at least two socket contacts and configured to receive voltage from connection conductors; two contact cavities arranged in the lower structure of the socket body wherein a respective connection contact of the at least two connection contacts is arranged in each of the two contact cavities and accessible through a respective insertion opening.

7 Claims, 7 Drawing Sheets

LAMP SOCKET WITH VENTILATION CHANNEL

RELATED APPLICATIONS

This application claims priority from and incorporates by reference German Patent Application DE 10 2021 112 797.1 filed on May 18, 2021.

FIELD OF THE INVENTION

The invention relates to a G9 lamp socket for a cooking appliance light.

BACKGROUND OF THE INVENTION

G9 lamps have a rather simple configuration and are rather tough and inexpensive to produce so that they are rather widely used in particular fields e. g. in cooking appliances. In a G9 lamp an end of the lamp cylinder that supports the socket contacts is pressed to form a bar, wherein foil conductors are connected at the socket contacts wherein the foil conductors are in turn connected to a glow filament arranged in the lamp cylinder.

The foil conductors arranged in the socket of the G9 lamp are temperature sensitive. Overheating the socket can cause the foil conductor to melt which leads to an interruption of the electrical contact. In G9 lamp sockets for cooking appliances, in particular ovens, the socket body that supports the G9 lamp is configured as a heat sink or a cooling body. The socket body absorbs excess heat from the lamp socket and dissipates the excess heat.

DE 40 31 167 A1 discloses a socket for threaded lamps e.g: according to E39 standard. This socket forms a pot shaped receiver for the lamp cylinder wherein ventilation openings are introduced into the socket in a portion of the lamp cylinder and configured to reduce a temperature of the lamp cylinder.

BRIEF SUMMARY OF THE INVENTION

Thus, it is an object of the invention to optimize an operating temperature range of a G9 lamp.

The object is achieved by a G9 lamp socket for a cooking appliance light, the G9 lamp socket including a socket body including an upper structure and a lower structure; a base receiver configured to receive a lamp base of a G9 lamp, the base receiver including an entry opening formed in the upper structure and extending along a longitudinal axis of the socket body into the lower structure; at least two socket contacts arranged opposite to one another wherein the base receiver is arranged between the at least two socket contacts; at least two connection contacts connected with the at least two socket contacts and configured to receive voltage from connection conductors; two contact cavities arranged in the lower structure of the socket body wherein a respective connection contact of the at least two connection contacts is arranged in each of the two contact cavities and accessible through a respective insertion opening; a retaining spring including two spring arms arranged on radially opposite sides of the base receiver and oriented transversal to the at least two socket contacts, wherein the socket body includes a ventilation channel that extends through a material of the socket body into the base receiver and facilitates an air exchange between the G9 lamp and ambient.

Thus, the ventilation channel extends diametrically through the socket body and passes through the section of the base receiver that is arranged in the lower structure of the socket body so that a ventilation air flow can enter the socket body on one side and exit the socket body again on the opposite side of the socket body.

This air flow can run past a lamp socket inserted into the base receiver and dissipate heat generated therein. Consequently, the lamp socket temperature can be kept below a level that is critical for the foil conductor which assures reliable illumination of the cooking appliance.

In a particularly advantageous embodiment where the ventilation channel is configured as a ventilation gap that divides the lower structure of the socket body into studs that are radially separated from each other by the ventilation gap, in particular when the section of the base receiver arranged in the lower structure is part of the ventilation gap, the air volume that is replaceable by respective air flow can be maximized which provides particularly good dissipation so that the cooling of the lamp socket is particularly effective.

Thus, it is furthermore provided that the base receiver runs axially through a bottom of the socket body in a portion of the ventilation gap.

Furthermore, a retaining spring for the lamp socket is arranged in the base receiver wherein the retaining spring includes two opposite spring arms that form a retaining gap between one another wherein free ends of the spring arms extend towards the lower structure.

This assures that the retaining spring typically inserted into the lower structure and applied against an insertion direction of a G9 lamp is reliably fixed at the socket body in spite of the ventilation channel and the ventilation gap.

BRIEF DESCRIPTION OF THE DRAWINGS

Further advantages and an even better understanding thereof can be derived from the subsequent description of an embodiment with reference to drawing figures wherein.

DETAILED DESCRIPTION OF THE INVENTION

Figure 1:
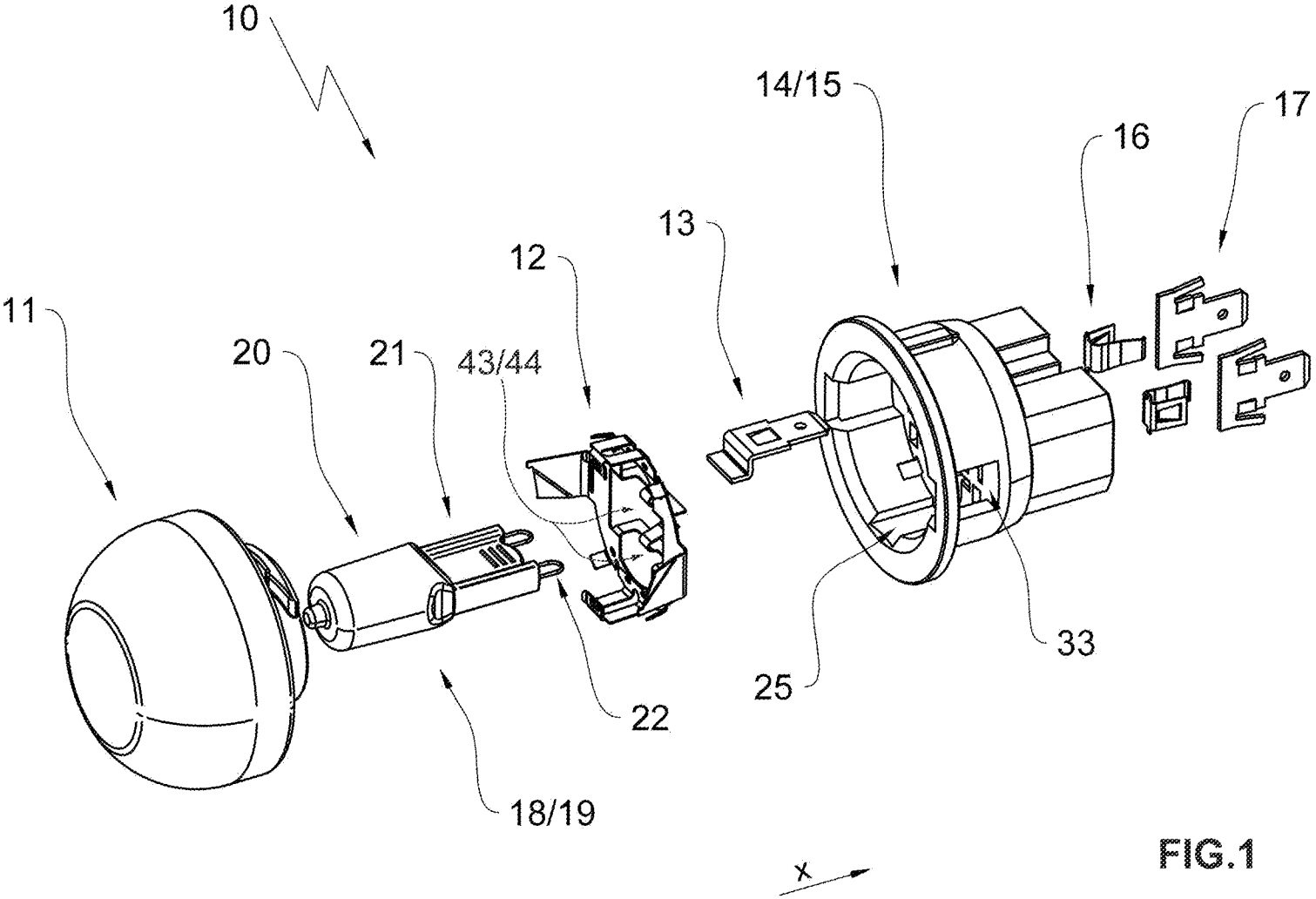
FIG. 1 illustrates an exploded view of an oven light including a lamp socket according to the invention.

The drawing figures show an oven light according to the invention overall designated with reference numeral 10.

FIG. 1 illustrates the oven light 10 according to the invention in an exploded view. The oven light 10 includes a light glass 11, an attachment ring 12 with a ground conductor connection 13, a lamp socket 14 formed by a socket body 15, socket contacts 16 and connection contacts 17 configured to supply voltage to the light.

A G9-lamp 19 is used for an illuminant 18 wherein a lamp cylinder 20 is formed into a bar shaped lamp base 21 at an end of the lamp cylinder that is proximal to the socket in the insertion direction X, wherein base contacts 22 originate from the lamp base 21.

Figure 2:
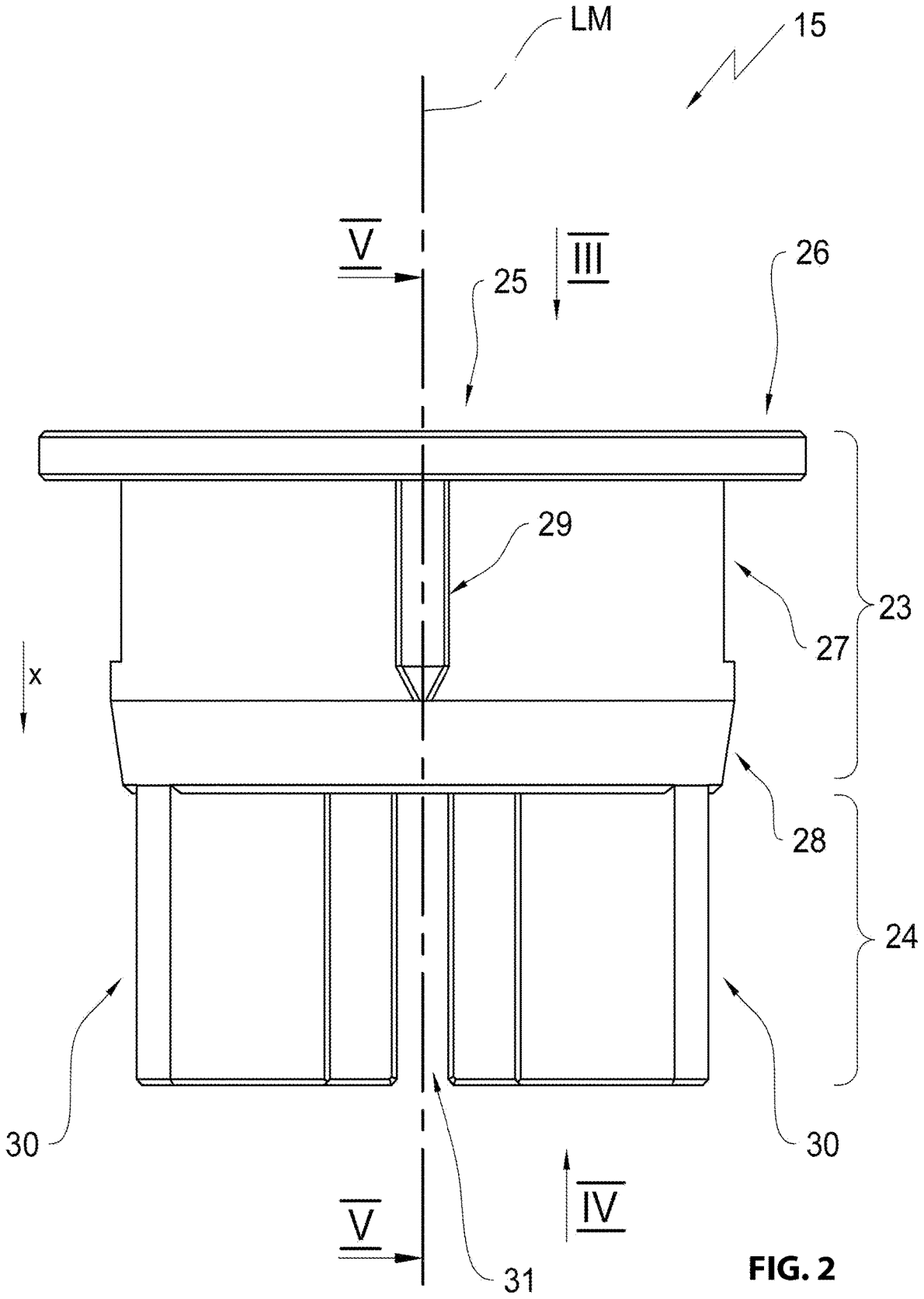
FIG. 2 illustrates the lamp socket of the oven light of FIG. 1 in a side view.

FIG. 2 illustrates the socket body 15 that forms the lamp socket 14 in a first side view. The socket body 15 includes an upper structure 23 and a lower structure 24. The upper structure 23 forms a pot shaped recess that is open in a direction towards the light glass 11 and wherein the insertion opening 25 of the pot shaped recess for the G9 lamp 19 is enveloped by a retaining flange 26. A circular cylindrical wall section 27 adjoins the retaining flange 26 in the insertion direction X, wherein the circular cylindrical wall section 27 contacts a socket base 28. The retaining flange 26, the wall section 27 and the socket base 28 are part of the upper structure 23. The wall section 27 includes a coding bar 29 that cooperates with a coding cut out of a cooking cavity wall in order to provide positionally correct arrangement of the socket body 15 that is secured against rotation. The lower structure 24 of the socket body 15 is formed by two studs 30 that originate from a socket base 28 in the insertion direction X and are offset from one another by a ventilation gap 31. Thus, the ventilation gap 31 is arranged parallel to a longitudinal center axis LM of the socket body 15 that is arranged parallel to the insertion direction X. The ventilation gap 31 thus defines an axial separation plane between the studs 30.

Figure 3:
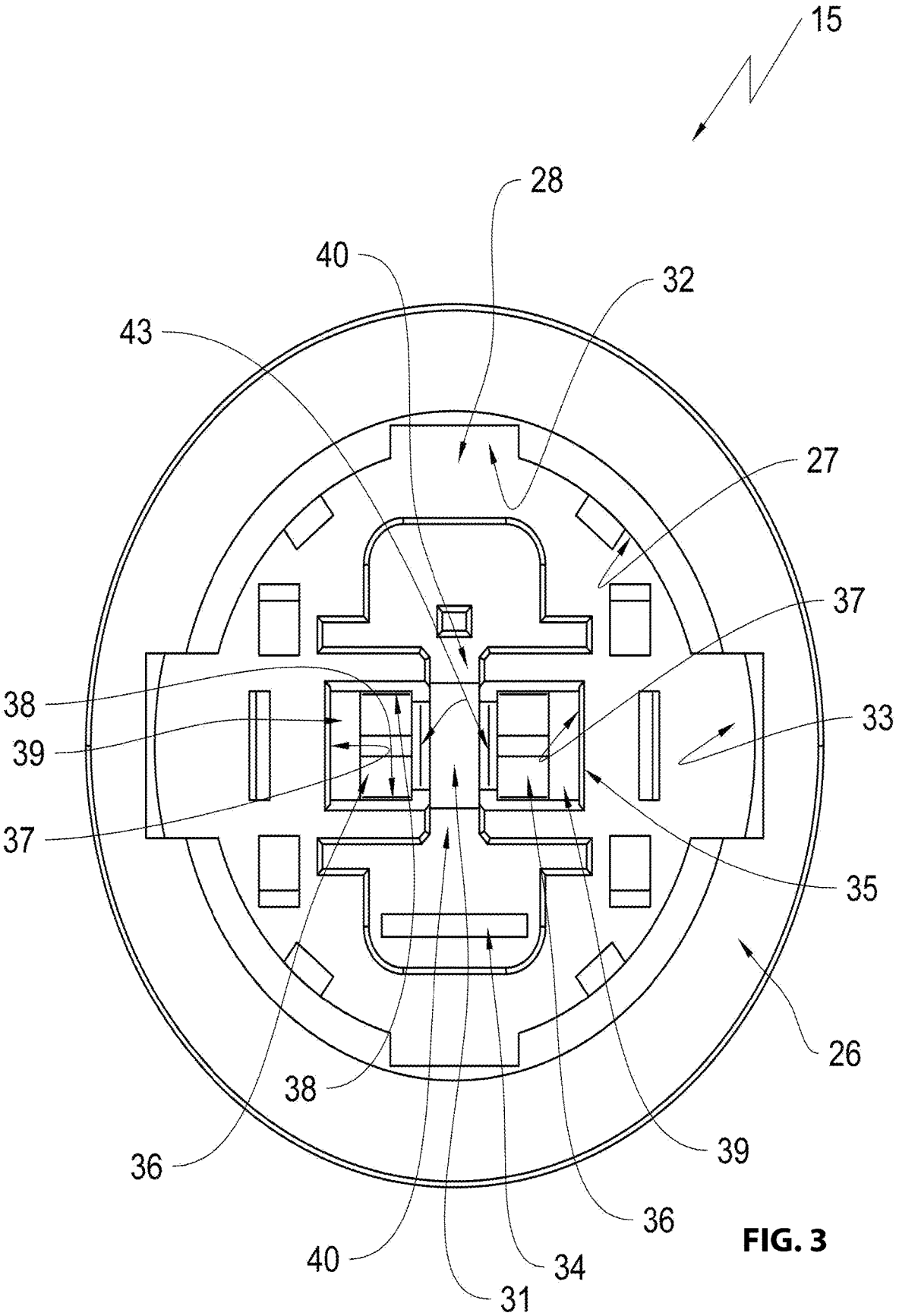
FIG. 3 illustrates the lamp socket according to FIG. 2 in a top view.

FIG. 3 shows the socket body 15 in a top view, thus in a view in the insertion direction X of the lamp 19 into the socket 14. This corresponds to the viewing arrow III in FIG. 2. The support flange 26 is visible that is oriented towards the viewer and the socket base 28 formed by the upper structure 23 that separates the upper structure 23 from the lower structure 24. Relief cuts 32 and cut outs 33 in the wall section 27 align and support the attachment ring 12.

The socket base 28 includes various openings. Thus e.g. the ground conductor slot 34 receives the ground conductor connection 13 whose contact end exits below the socket base 28 in the lower structure 24, so that a ground conductor can be connected at this location. An approximately rectangular relief cut 32 is provided in a center of the socket base 28 wherein the relief cut forms the base receiver 35 into which the socket 29 of the G9 lamp 19 (c.f. FIG. 1) can be inserted. The approximately rectangular base receiver 35 includes two contact recesses 36 into which the base contacts 22 and lamp base 21 are inserted. The base receiver 35 is defined by two face walls 37 that are arranged opposite to each other and by two transversal walls 38 that are also arranged opposite to each other and formed by the socket body 15. Each contact recess is provided with a socket contact cut out 39 that is parallel to the face walls and that extends into the stud 30 respectively arranged there under, wherein the socket contacts are inserted into the socket contact cut out.

Each transversal wall 38 is penetrated approximately in a center by a retaining spring 43 engagement feature 40, wherein each retaining spring 43 engagement feature 40 arranges a spring arm 44 of a retaining spring 43 that interlocks and fixes the lamp base 21.

Last not least FIG. 3 also shows that the base of the base receiver 35 is at least partially open in a downward direction so that at least the portion of the base receiver 35 that is arranged in the lower structure 24 of the socket body 15 transitions into the ventilation gap 31 or is part of the ventilation gap 31.

Figure 4:
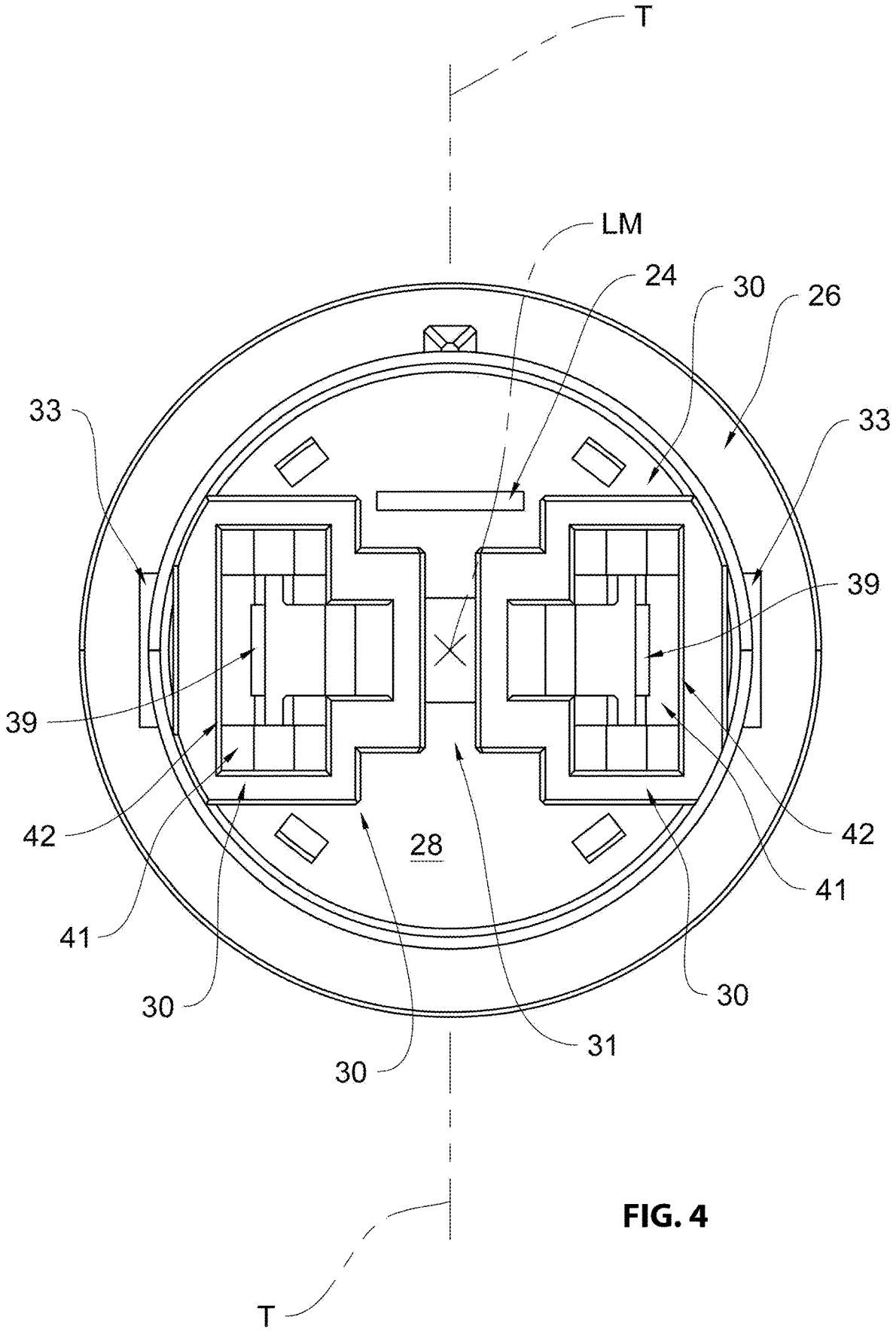
FIG. 4 illustrates the socket according to FIG. 2 in a bottom view.

FIG. 4 illustrates a view of the socket body 15 from below, thus in a view against the insertion direction X of the G9 lamp 19 into the lamp socket 14. This corresponds to the viewing arrow IV in FIG. 2. This shows a bottom side of the socket base 28 and the ground conductor slot 24 that extends from the top side through the socket base 28. The bottom side of the retaining flange 26 and portions of the cut outs 33 are also visible in as far as the cut outs reach into the retaining flange 26. The studs 30 arranged in the lower structure 24 of the socket body 15 that extend from the socket base 28 in the insertion direction X respectively form a contact cavity 41, that is respectively accessible through an insertion opening 32. Each contact cavity 41 receives a connection contact 17 to supply the G9 lamp 19 with electricity, wherein FIG. 4 shows that the socket contact cut out 39 reaches into each contact cavity 41.

In the illustrated embodiment, the ventilation channel according to the invention is formed by the ventilation gap 41 already described with reference to FIG. 2. The ventilation gap 31 extends orthogonal to the socket base 38 and therefrom in the insertion direction X. The ventilation gap 31 defines an axially oriented separation plane T in which the longitudinal center axis LM of the socket body 15 is arranged. The separation plane T divides the lower structure 24 into two studs 30 offset from one another in a radial direction and extends diametrically through the lower structure 24.

Figure 5:
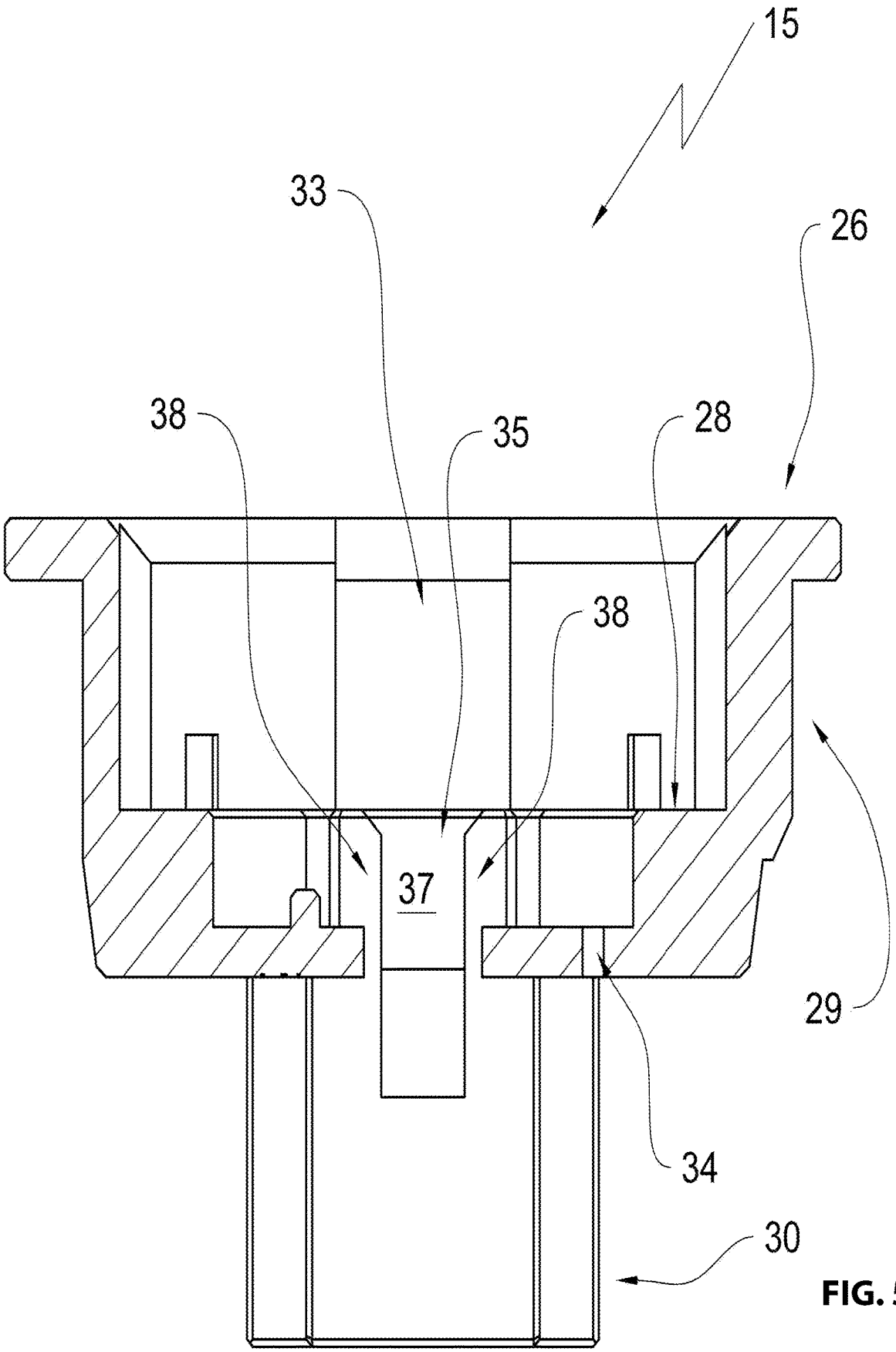
FIG. 5 illustrates a sectional view of the socket according to sectional line V-V in FIG. 2.

FIG. 5 shows a sectional view of the socket body 15 along the sectional plane V-V in FIG. 2.

This sectional view of the upper portion shows the cut out 33 that positions the attachment ring 12 and shows the base receiver 35 with its transversal walls 38 and the face wall 37.

Figure 6:
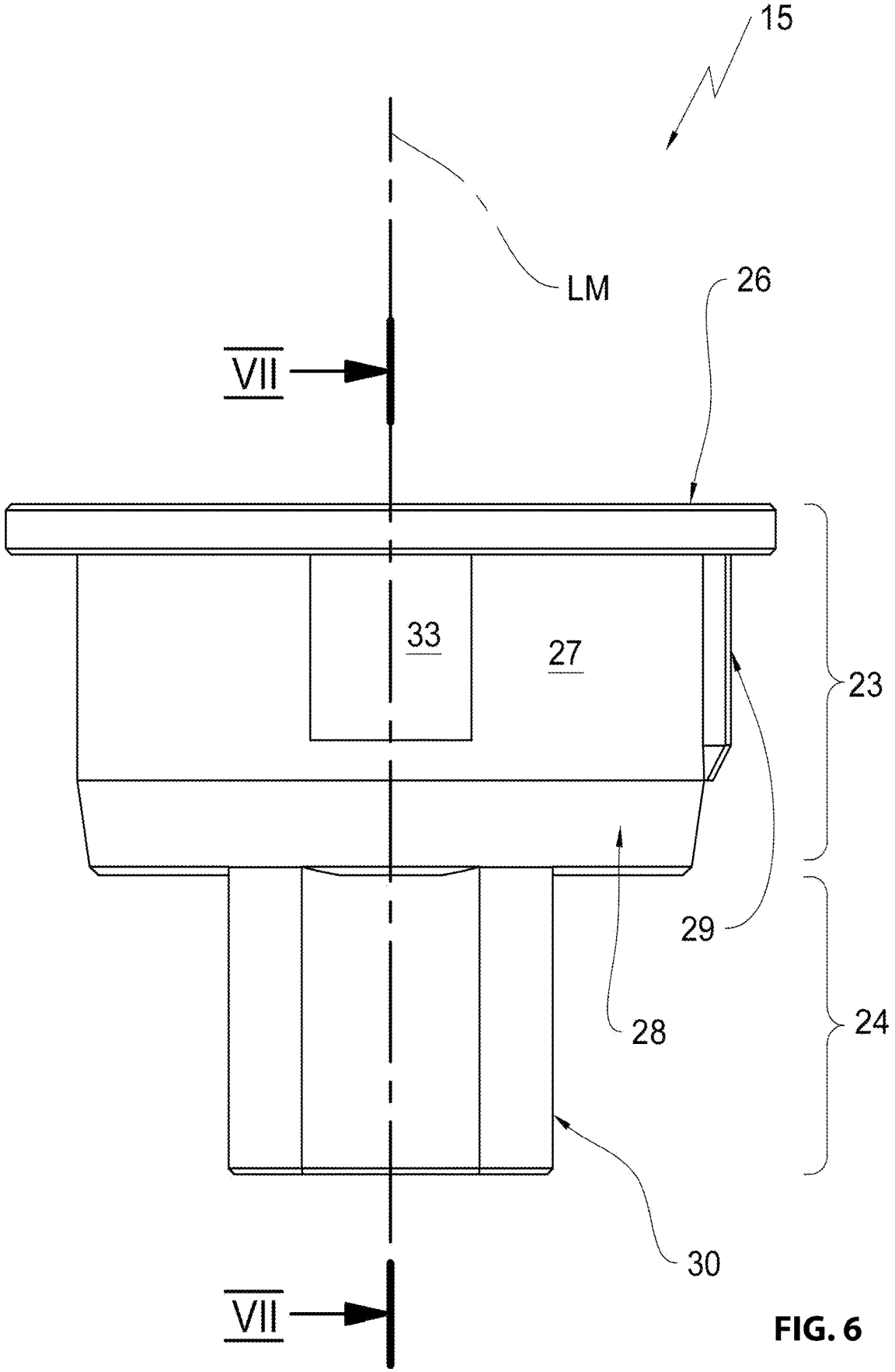
FIG. 6 illustrates a side view of the socket rotated relative to FIG. 2 by 90° about the longitudinal axis.
Figure 7:
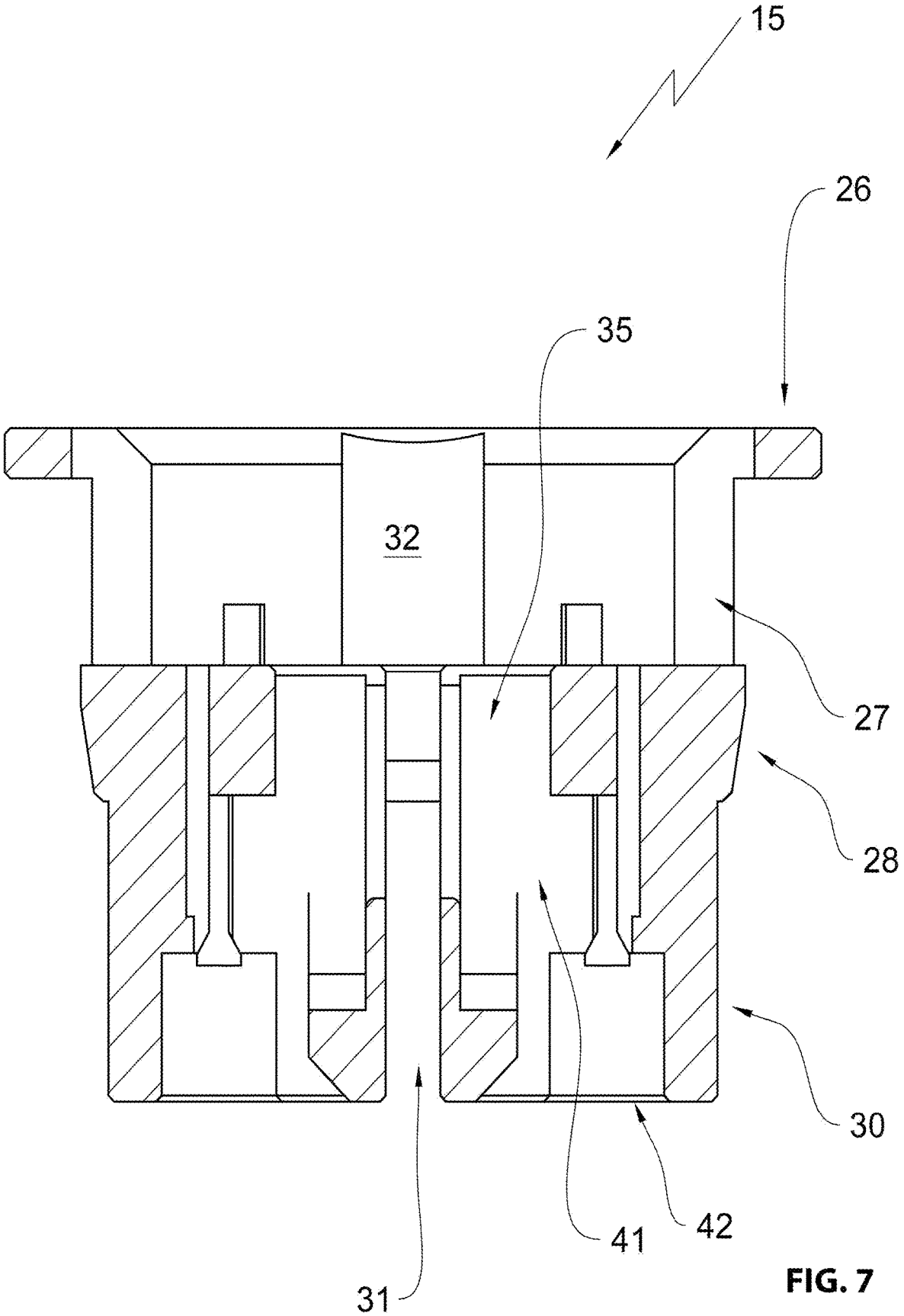
FIG. 7 illustrates a sectional view according to sectional line VII-VII in FIG. 6.

FIG. 6 shows a side view of the socket body 15 wherein the orientation of the socket body 15 was rotated relative to FIG. 2 by 90° about the longitudinal center axis LM. According to the sectional axis VII-VII, FIG. 7 shows a sectional view.

It is evident from FIG. 7 that the base receiver 35 extends into the portion below the socket base 28 and thus forms part of the ventilation gap 31 so that heat dissipation is always provided through a large exchangeable air volume.

The Invention provides a ventilation channel 31 in a G9 lamp socket that cools the socket of a G9 lamp. This ventilation channel 31 is arranged in the lower structure 24 of the socket body 15 and is therefore arranged below the socket base 28 and thus forms part of the base receiver 35 of the lamp socket 14. This provides controlled cooling of the G9 lamp base 21.

The illustrated embodiment shows an optimum configuration of the ventilation channel 31 configured as a ventilation gap which extends diametrically through the lower structure 24 of the socket body 15 and is configured without a closure base from the socket base 28 in the insertion direction X. Therefore, the lower structure 24 of the socket body 15 is divided into two diametrically offset non-connected studs 30 whose distance measured in the radial direction determines a width of the ventilation gap 31.

The base receiver 35 extends into the lower structure 24 so that the base receiver 35 forms part of the ventilation gap 31. In an advantageous embodiment the retaining spring 43 for the lamp base 21, engages the base receiver 35 from above so that the spring arms 44 of the retaining spring 43 extend with their free ends in the insertion direction X towards the lower structure 24 and connected ends of the spring arms 44 are arranged in the upper structure 23 of the socket body 15.

REFERENCE NUMERALS AND DESIGNATIONS

10 oven light
11 light glass
12 attachment ring
13 ground conductor connection
14 lamp socket

15 lamp socket body
16 socket contact
17 connection contact
18 illuminant
19 G9 lamp
20 lamp cylinder
21 lamp base
22 base contact
23 upper structure
24 lower structure
25 insertion opening
26 retaining flange
27 wall section
28 socket base
29 coding bar
30 stud
31 ventilation gap
32 relief cut
33 cut out
34 ground conductor slot
35 base receiver
36 contact recess
37 face wall
38 transversal wall
39 socket contact cut out
40 retaining spring engagement feature
41 contact cavity
42 insertion opening
43 retaining spring
44 spring arm
X insertion direction
LM longitudinal center axis
T separation plane

What is claimed is:

1. A G9 lamp socket for a cooking appliance light, the G9 lamp socket comprising:

a socket body including an upper structure and a lower structure;

a base receiver configured to receive a lamp base of a G9 lamp, the base receiver including an entry opening formed in the upper structure and extending along a longitudinal axis of the socket body into the lower structure;

at least two socket contacts arranged opposite to one another wherein the base receiver is arranged between the at least two socket contacts;

at least two connection contacts connected with the at least two socket contacts and configured to receive voltage from connection conductors;

two contact cavities arranged in the lower structure of the socket body wherein a respective connection contact of the at least two connection contacts is arranged in each of the two contact cavities and accessible through a respective insertion opening;

a retaining spring including two spring arms arranged on radially opposite sides of the base receiver and oriented transversal to the at least two socket contacts, wherein the socket body includes a ventilation channel that extends through a material of the socket body into the base receiver and facilitates an air exchange between the G9 lamp and ambient, and wherein the ventilation channel is configured as a ventilation gap that separates the lower structure of the socket body radially into two studs that are offset from one another by the ventilation gap.

2. The lamp socket according to claim 1, wherein the ventilation channel extends diametrically through the socket body and passes through a section of the base receiver arranged in the lower structure.

3. The lamp socket according to claim 1, wherein the base receiver is arranged between the two contact cavities.

4. The lamp socket according to claim 1, wherein a section of the base receiver arranged in the lower structure is part of the ventilation gap.

5. The lamp socket according to claim 1, wherein each stud of the two studs of the lower structure forms one contact cavity of the two contact cavities and the respective insertion opening is arranged at an end of each stud that is oriented away from the upper structure.

6. The lamp socket according to claim 1, wherein the base receiver runs through the socket body in an axial direction and includes an open end in a portion of the ventilation gap.

7. The lamp socket according to claim 1, wherein the retaining spring for the base is arranged in the base receiver, wherein the retaining spring includes the two spring arms that are arranged opposite to each other and form a retaining gap between each other, and wherein free ends of the two spring arms extend in a direction towards the lower structure.

* * * * *